US007310968B2

(12) United States Patent
Kamm

(10) Patent No.: US 7,310,968 B2
(45) Date of Patent: Dec. 25, 2007

(54) DEVICE FOR FREEZING AND/OR REFRIGERATING ARTICLES IN A REFRIGERATION ROOM EQUIPPED WITH A FAN

(75) Inventor: Volker Kamm, Oberschleissheim (DE)

(73) Assignee: Linde Aktiengesellschaft, Wiesbaden (DE)

( * ) Notice: Subject to any disclaimer, the term of this patent is extended or adjusted under 35 U.S.C. 154(b) by 210 days.

(21) Appl. No.: 11/110,787

(22) Filed: Apr. 21, 2005

(65) Prior Publication Data

US 2005/0235676 A1 Oct. 27, 2005

(30) Foreign Application Priority Data

Apr. 22, 2004 (DE) ..... 10 2004 020 194

(51) Int. Cl.
*F25D 25/04* (2006.01)
*F25D 17/04* (2006.01)

(52) U.S. Cl. ..... 62/380; 62/404; 198/952

(58) Field of Classification Search ..... 62/63, 62/374, 378, 380, 404, 186; 198/801, 952
See application file for complete search history.

(56) References Cited

U.S. PATENT DOCUMENTS 2,682,755 A 7/1954 Mather
3,531,946 A 10/1970 Hart
3,605,434 A 9/1971 Boese
3,805,538 A * 4/1974 Fritch et al. ..... 62/63
4,912,943 A * 4/1990 Hubert et al. ..... 62/374
5,168,711 A * 12/1992 Moore et al. ..... 62/63
5,460,015 A * 10/1995 Venetucci ..... 62/374
5,485,731 A 1/1996 Venetucci et al.
5,520,013 A * 5/1996 Kuo ..... 62/380
5,683,240 A * 11/1997 Smith et al. ..... 432/59
6,233,841 B1 * 5/2001 Beach ..... 34/262
6,334,330 B2 * 1/2002 Lang et al. ..... 62/374
6,427,455 B1 * 8/2002 Furubayashi ..... 62/93
6,434,950 B2 * 8/2002 Newman et al. ..... 62/63
6,675,589 B1 * 1/2004 Howard ..... 62/63

FOREIGN PATENT DOCUMENTS

JP 7-280405 A * 10/1995

* cited by examiner

*Primary Examiner*—Mohammad M. Ali
(74) *Attorney, Agent, or Firm*—Crowell & Moring LLP

(57) ABSTRACT

A device for freezing and/or refrigerating articles, in which at least one cold gas generating device is provided in a refrigeration room and at least one fan is provided for distributing the cold gas in the refrigeration room. The fan is connected to a drive motor. In order not to damage the drive motor when cleaning the refrigeration room, the drive motor is accommodated in a motor room which is separate from the refrigeration room.

6 Claims, 1 Drawing Sheet

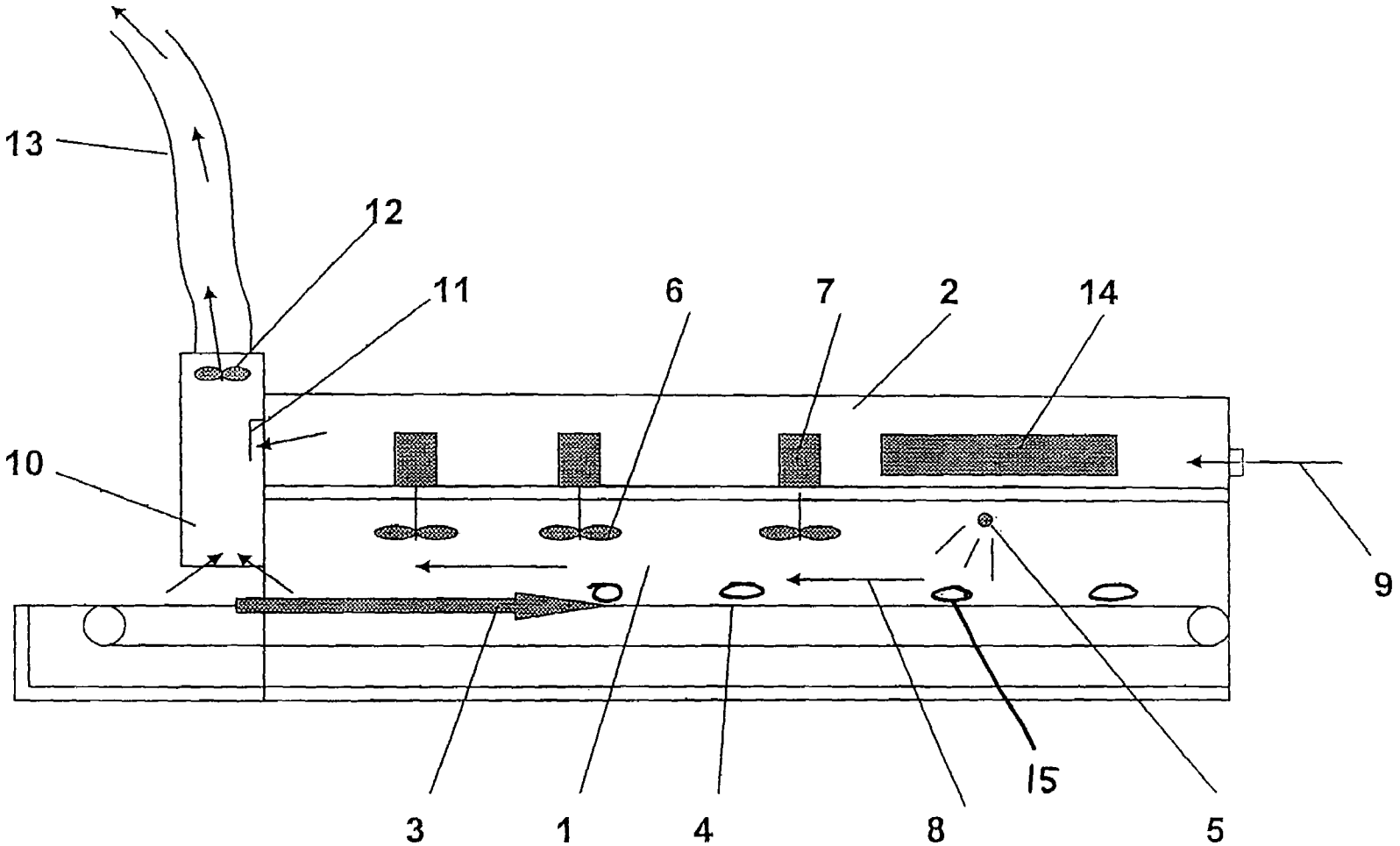
9
14
2
7
6
11
12
13
10
5
15
8
4
1
3

DEVICE FOR FREEZING AND/OR REFRIGERATING ARTICLES IN A REFRIGERATION ROOM EQUIPPED WITH A FAN

This application claims the priority of German Application No. 102004020194.3, filed Apr. 22, 2004, the disclosure of which is expressly incorporated by reference herein.

BACKGROUND AND SUMMARY OF THE INVENTION

This invention relates to a device for freezing and/or refrigerating articles in a refrigeration room equipped with a conveyor device for conveying the articles through the refrigeration room and at least one cold gas generating device for generating a cold gas atmosphere in the refrigeration room and at least one fan for distributing the cold gas, the fan being connected to a drive motor.

Such refrigeration equipment is used for freezing foods, for example. With so-called tunnel freezers, for example, the foods are conveyed continuously on a conveyor belt through a tunnel-like refrigeration room. A cold gas generating device, e.g., in the form of a liquid gas spray nozzle is situated in the refrigeration room. The liquid gas sprayed into the refrigeration room is distributed uniformly in the refrigeration room by fans. The foods conveyed through the refrigeration room are therefore cooled or frozen uniformly. Motors mounted outside the refrigeration room are generally used to drive the fans. The heat loss by the motors can be dissipated with no problem in this way. In the case of externally mounted motors, however, there have been repeated cleaning problems and/or problems due to damage to the motors due to cleaning agents. Hygiene problems also occur due to cables, cable shafts and other equipment mounted on the tunnel freezer.

The object of the present invention is to prevent damage to the motors due to cleaning agents and to improve hygiene.

This object is achieved according to this invention by the fact that the drive motor is accommodated in a motor room that is separate from the refrigeration room. Due to the arrangement of the drive motor and optionally other components in the motor room, this equipment can no longer become soiled.

In the case of tunnel freezers, the entire cover area in which the drive motors for the fans are mounted is expediently provided with a lining. Therefore, the drive motors are no longer situated in the cleaning area and thus, they have a much longer service life.

The lining of the motor room should be removable so that access is possible for maintenance purposes. The lining is preferably made of plastic so that it is easy to remove. Alternatively, it may also be mounted with a hinge so that it can be raised like a flap. It may also be made of stainless steel. In the case of an embodiment of the lining made of plastic, various pigmentations are also possible, which may increase the visual attractiveness.

The lining is expediently mounted with quick-lock screws so that it can be removed quickly. To optimally protect the motor room from soiling and from cleaning agents, the lining is advantageously installed with a peripheral gasket.

Other items of equipment which are also placed in the motor room are also preferably kept clean and protected from corrosion due to cleaning agents. These include, for example, gas fittings, control and regulating fittings, sensors, electric terminal boxes or control panels and other components.

To ensure cooling of the drive motors, preferably a cool air supply and an exhaust air vent are provided. Room air is advantageously drawn in at one end of the device, sucked through the motor room, during which it picks up the waste heat of the drive motors, and finally dissipated through an exhaust air vent at the upper end of the device. According to a preferred embodiment of this invention, the exhaust air vent opens into an exhaust shaft which is provided with an exhaust apparatus and receives exhaust from the refrigeration room. Such an exhaust shaft is usually present anyway in a freezer apparatus which operates with cold gas. Thus, the exhaust air is drawn in from the motor room by means of the exhaust and mixed with cold exhaust gas from the refrigeration room. The mixed exhaust gas is finally vented to the outside.

Due to a labyrinth, an arrangement of the exhaust air vent opens into the exhaust shaft, and care should be taken to ensure that no cleaning agent from the refrigeration room can enter the motor room. Preferably, a filter is used at least on the intake side to prevent dust or the like from also being sucked in.

A cryogenic tunnel freezer is usually operated in countercurrent, i.e., the exhaust shaft is situated in the area of the product feed. If operating in cocurrent, the cooling air stream can simply be blown in the opposite direction through the motor room and vented at the product outlet.

According to a refinement of the inventive idea, the motor room has a cold gas feed. For example, the drive motors in the motor room may be cooled by a small amount of cold nitrogen gas flowing out since this is available with a tunnel freezer anyway. Additionally or alternatively, an evaporator may also be provided in the motor room, generating cold gas from a liquid gas source. The resulting cold gas may additionally be used for other applications.

According to a particularly preferred embodiment, the cold gas feed and/or the evaporator has a temperature-dependent regulation.

If cold gas is injected directly for cooling the drive motors situated in the motor room or if cold gas is generated by an evaporator in the motor room, then a room air intake should be omitted because otherwise precipitation of moisture (condensation) will occur.

This invention may be used with all conceivable devices for freezing and/or cooling articles in which the articles in a refrigeration room are exposed to a cold gas atmosphere which is uniformly distributed in the refrigeration room by fans. This invention may be used to particular advantage with equipment for freezing and/or refrigerating foods in so-called freezers, in particular, in tunnel freezers.

This invention is associated with a number of advantages:

Due to the arrangement of the drive motors in a separate motor room, the hygiene situation is greatly improved. Furthermore the running time of the drive motors is significantly prolonged without requiring any additional space in the interior of the freezing apparatus. Easy replacement of drive motors is ensured. Furthermore, adequate cooling of the drive motors is also ensured.

Other objects, advantages and novel features of the present invention will become apparent from the following detailed description of the invention when considered in conjunction with the accompanying drawings.

BRIEF DESCRIPTION OF THE DRAWING

FIG. 1 is a schematic illustration of a tunnel freezer device in accordance with an embodiment of the present invention.

DETAILED DESCRIPTION

The FIGURE shows a tunnel freezer for freezing foods. The tunnel freezer has a tunnel-like refrigeration room 1 through which foods 15 are conveyed on a conveyor belt 4 in the direction of travel 3 of the belt. At least one injector 5 spraying liquid nitrogen onto the foods 15 is mounted in the refrigeration room 1. By means of fans 6 the nitrogen gas atmosphere formed due to evaporation of the liquid nitrogen is distributed uniformly in the refrigeration room 1. The fans 6 are driven by means of drive motors 7 mounted in a separate motor room 2, along with other equipment 14. The drive motors 7 are cooled in the motor room 2 by a refrigerated air supply 9. An exhaust shaft 10 is provided in the feed area of the tunnel freezer. The cold gas in the refrigeration room 1 flows in the opposite direction 8 to the conveyor device 3 of the foods 15, leaving the tunnel freezer through the exhaust shaft 10. The motor room 2 has an exhaust air vent 11 which opens into the exhaust shaft 10. This achieves the effect that room air is drawn by the exhaust apparatus 12 through the refrigerated air supply 9 through the motor room 2 and into the exhaust shaft 10 via the exhaust vent 11. In the exhaust shaft 10, the cooling air which has been removed from the motor room 2 and heated up to the waste heat of the drive motors 7 is blown to the outside together with the exhaust gas vented from the refrigeration room 1 and ultimately released to the outside through an exhaust channel 13.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof

What is claimed is:

1. Device for freezing and/or refrigerating articles in a refrigeration room equipped with a conveyor device for conveying the articles through the refrigeration room and having at least one cold gas generating apparatus for generating a cold gas atmosphere in the refrigeration room and at least one fan for distributing the cold gas, the fan being connected to a drive motor, wherein the drive motor and gas fittings of the at least one cold gas generating apparatus are accommodated in a motor room that is separate from a refrigeration room.

2. Device as claimed in claim 1, wherein the motor room has a refrigerated air supply and an exhaust air vent.

3. Device as claimed in claim 2, wherein the exhaust air vent opens into an exhaust shaft which is equipped with an exhaust apparatus and receives exhaust gas from the refrigeration room.

4. Device as claimed in claim 1, wherein the motor room has a cold gas supply.

5. Device as claimed in claim 1, wherein an evaporator is provided in the motor room to generate cold gas.

6. Device as claimed in claim 1, wherein the device is designed as a food freezer.

* * * * *